US006061877A

United States Patent [19]

Leifeld et al.

[11] Patent Number: 6,061,877

[45] Date of Patent: May 16, 2000

[54] CLOTHING FOR A ROLL ADVANCING FIBER MATERIAL

[75] Inventors: Ferdinand Leifeld, Kempen; Armin Leder, Mönchengladbach, both of Germany

[73] Assignee: Trützschler GmbH & Co. KG, Mönchengladbach, Germany

[21] Appl. No.: 09/033,075

[22] Filed: Mar. 2, 1998

[30] Foreign Application Priority Data

Feb. 28, 1997 [DE] Germany ..... 197 08 261

[51] Int. Cl.[7] ..... D01G 15/40

[52] U.S. Cl. ..... 19/105; 19/98; 19/114

[58] Field of Search ..... 19/98, 99, 10, 19/105, 112, 115, 114; 492/53, 56, 30, 35, 43, 44

[56] References Cited

U.S. PATENT DOCUMENTS

| | | | |
|---|---|---|---|
| 3,762,144 | 10/1973 | Didek et al. | 19/105 |
| 4,221,022 | 9/1980 | Iida | 19/114 |
| 4,274,177 | 6/1981 | Grimshaww et al. | 19/100 |
| 4,697,309 | 10/1987 | Rudolph | 19/105 |
| 4,833,757 | 5/1989 | Stahlecker . | |
| 4,937,919 | 7/1990 | Graf | 19/114 |
| 4,953,264 | 9/1990 | Hollingsworth et al. | 19/114 |
| 5,125,132 | 6/1992 | Weber | 19/105 |
| 5,423,176 | 6/1995 | Stahlecker et al. | 19/114 |
| 5,426,824 | 6/1995 | Gloor et al. | 19/115 |
| 5,555,714 | 9/1996 | Mladek et al. | 19/112 |
| 5,604,957 | 2/1997 | Leifeld | 19/105 |
| 5,642,611 | 7/1997 | Stahlecker . | |
| 5,737,806 | 4/1998 | Leifeld et al. | 19/98 |

FOREIGN PATENT DOCUMENTS

| | | |
|---|---|---|
| 37 05 148 | 9/1988 | Germany . |
| 39 29 341 | 3/1991 | Germany . |
| 40 19 151 | 12/1991 | Germany . |
| 43 31 284 | 3/1994 | Germany . |
| 932150 | 7/1963 | United Kingdom . |
| 1155605 | 6/1969 | United Kingdom . |
| 2 257 164 | 1/1993 | United Kingdom . |

*Primary Examiner*—Michael A. Neas
*Assistant Examiner*—Gary L. Welch
*Attorney, Agent, or Firm*—Venable; Gabor J. Kelemen

[57] ABSTRACT

A roll for advancing fiber material has a roll surface provided with a sawtooth clothing which includes a plurality of teeth separated from one another by respective tooth gaps each having a gap bottom. Each tooth has a frontal flank oriented in a direction of roll rotation and a tooth point. Each tooth having a tooth height $h_2$ measured from the roll surface to the tooth point and a tooth gap height $h_3$ measured from the tooth gap bottom to the tooth point. The tooth height $h_2$ and the tooth gap height $h_3$ are small for defining a small fill volume between teeth. Each tooth has a back angle $\gamma$ having a magnitude of at least approximately 90° and further has a large tooth division t and a large pitch P for defining a large open space about the teeth.

19 Claims, 4 Drawing Sheets

CLOTHING FOR A ROLL ADVANCING FIBER MATERIAL

CROSS REFERENCE TO RELATED APPLICATION

This application claims the priority of German Application No. 197 08 261.0 filed Feb. 28, 1997, which is incorporated herein by reference.

BACKGROUND OF THE INVENTION

This invention relates to a sawtooth clothing for a roll advancing fiber material, such as a feed roll which advances a fiber lap to a licker-in of a carding machine. The feed roll rotates slowly and forwards the fiber material with the leading tooth flanks, as viewed in the direction of roll rotation.

In a known sawtooth clothing for a feed roll, pointed teeth are provided and thus such clothing generally corresponds to the sawtooth clothing of the licker-in. The tooth height and the tooth gap height are relatively large so that the tooth gaps are filled with a substantial amount of fiber material. The tooth points are oriented opposite the direction of rotation of the feed roll; the back angle is approximately 30°. As a result of such a construction, the fiber material is pulled in as it sweeps over the trailing flank of the teeth, that is, in a somewhat force-locking manner which is disadvantageous as concerns the fiber advancing action. It is a further drawback that the tooth gaps are deep and are filled with a substantial amount of fiber material so that disadvantages may appear in measuring the thickness of the pulled-in fiber lap, particularly by virtue of the fact that only the small fiber part projecting beyond the tooth points is measured rather than the greater part of the fiber material which is situated in the tooth gaps.

SUMMARY OF THE INVENTION

It is an object of the invention to provide an improved sawtooth clothing of the above type from which the discussed disadvantages are eliminated and which, in particular, makes possible an improved conveyance of the fiber material and a more accurate detection of the thickness fluctuations of the fiber material pulled in by the feed roll.

This object and others to become apparent as the specification progresses, are accomplished by the invention, according to which, briefly stated, the roll for advancing fiber material has a roll surface provided with a sawtooth clothing which includes a plurality of teeth separated from one another by respective tooth gaps each having a gap bottom. Each tooth has a frontal flank oriented in a direction of roll rotation and a tooth point. Each tooth has a tooth height $h_2$ measured from the roll surface to the tooth point and a tooth gap height $h_3$ measured from the tooth gap bottom to the tooth point. The tooth height $h_2$ and the tooth gap height $h_3$ are small for defining a small fill volume between teeth. Each tooth has a back angle $\gamma$ having a magnitude of at least approximately 90° and further has a large tooth division t and a large pitch P for defining a large open space about the teeth.

By virtue of the fact that the tooth height above the roll surface and the tooth gap height are small, a small fill volume for the fiber material in the tooth gaps is present, that is, the apparatus for measuring thickness fluctuations of the fiber material may detect the fiber material in its entire depth. The back angle having a magnitude of at least approximately 90° makes possible a form-fitting entrainment of the fiber material and therefore a significantly improved conveyance thereof towards the licker-in. The combination, according to the invention, of the shape of the teeth with the rectangular flanks and the above-noted small dimensions advantageously permits an improvement as concerns the delivery and the thickness measurement of the fiber material. Despite the small teeth the fiber material is, because of the large back angle, entrained in an effective manner, and because of the small teeth and tooth gaps it is possible to reliably detect the fiber mass during the measuring process. By providing that for achieving an open space about the teeth, the tooth division and the pitch are large, that is, wide and not deep, an undesired feed of the fiber material between the teeth and between turns (windings) of the clothing are avoided.

The invention has the following additional advantageous features:

The breast angle $\alpha$ is 0° or approximately 0°. The wedge angle $\beta$ is 0° or approximately 0°. The tooth division t is approximately between 2.45 mm to 2.85 mm. The tooth gap is of approximately semicircular shape. The tooth gap at its opposite ends is approximately of quarter-circle configuration and the tooth gap has a planar bottom portion. The tooth length $\ell_S$ (measured in the circumferential direction of the roll) is greater than 0.5 mm. The tooth gap height $h_3$ is approximately between 0.6 mm and 1.5 mm. The tooth height $h_2$ is approximately between 0.8 mm and 1.5 mm. The point width $b_S$ (measured parallel to the roll axis) is greater than 0.2 mm and smaller than 1 mm. The foot width $b_F$ (measured parallel to the roll axis) is greater than 1 mm and smaller than 4 mm and is preferably 2 mm. The tooth density T is approximately between 3.5 and 4.0 teeth/cm. The number of turns z is approximately between 4.8 and 5.2 teeth/cm. The tooth distribution density B over the roll surface is approximately between 18.5 and 19.5 teeth/cm$^2$. The sawtooth clothing according to the invention may be used for example, as the delivery roll of a fiber tuft feeder for a carding machine or a cleaner or may be used as the intake roll for an opener or for a cleaner. The feed roll may be associated with a device for measuring thickness deviations of the conveyed fiber material.

DESCRIPTION OF THE PREFERRED EMBODIMENTS

Figure 1:
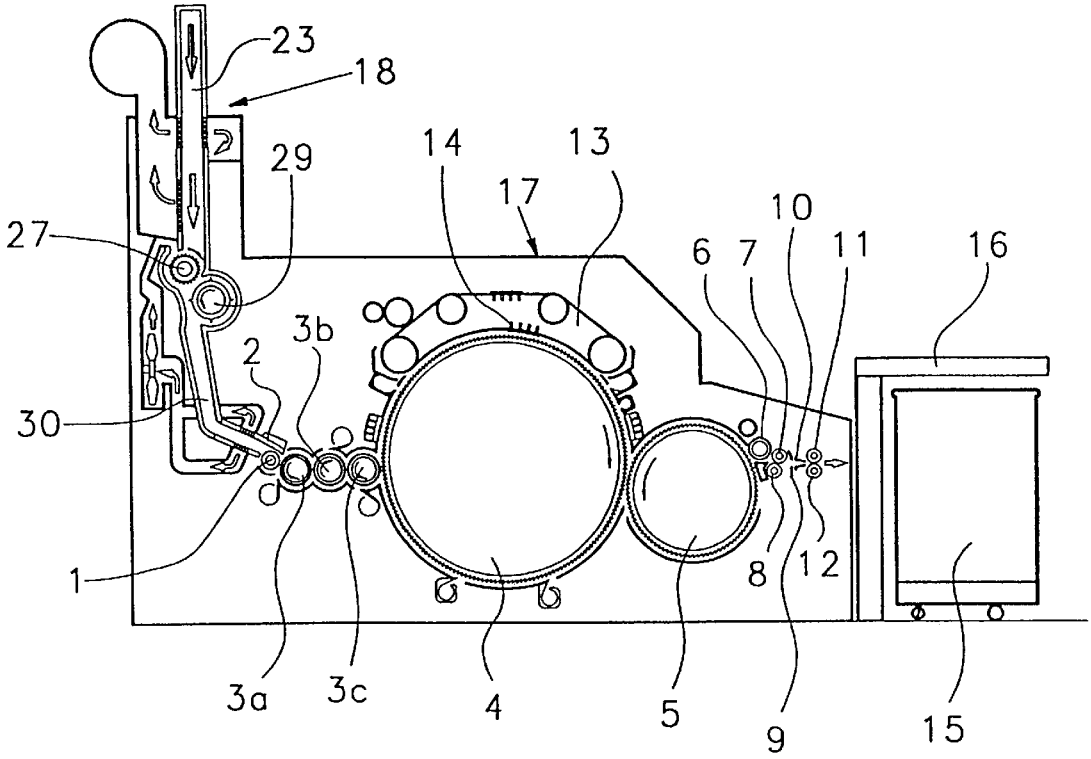
FIG. 1 is a schematic side elevational view of a fiber processing assembly formed of a fiber tuft feeder and an after-connected carding machine, incorporating the invention.

FIG. 1 illustrates a carding machine 17 which may be an EXACTACARD DK 803 model, manufactured by Tr ützschler GmbH & Co. KG, Mönchengladbach, Germany. The carding machine 17 has a feed roll 1, a feed plate 2 cooperating therewith, licker-ins 3*a*, 3*b*, 3*c*, a main carding cylinder 4, a doffer 5, a stripping roller 6, cooperating crushing rolls 7 and 8, a web guiding element 9, a sliver trumpet 10, cooperating calender rolls 11 and 12, travelling flats 13 including flat bars 15, a sliver coiler 16 and a coiler can 14.

Figure 5A:
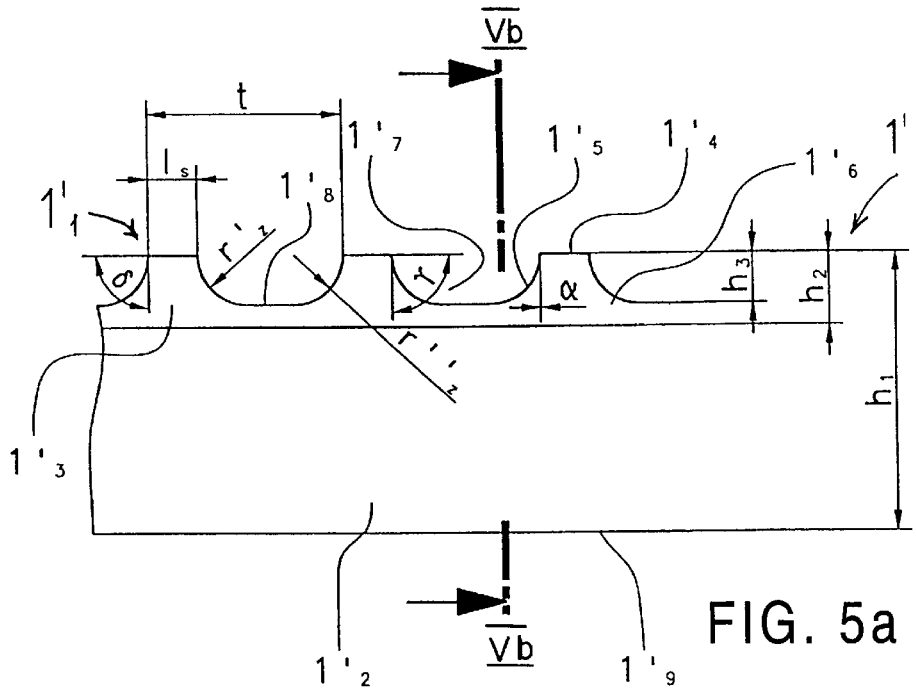
FIG. 5*a* is a side elevational view of a sawtooth clothing according to the invention, illustrated in a flat-lying (developed) state.
Figure 5B:
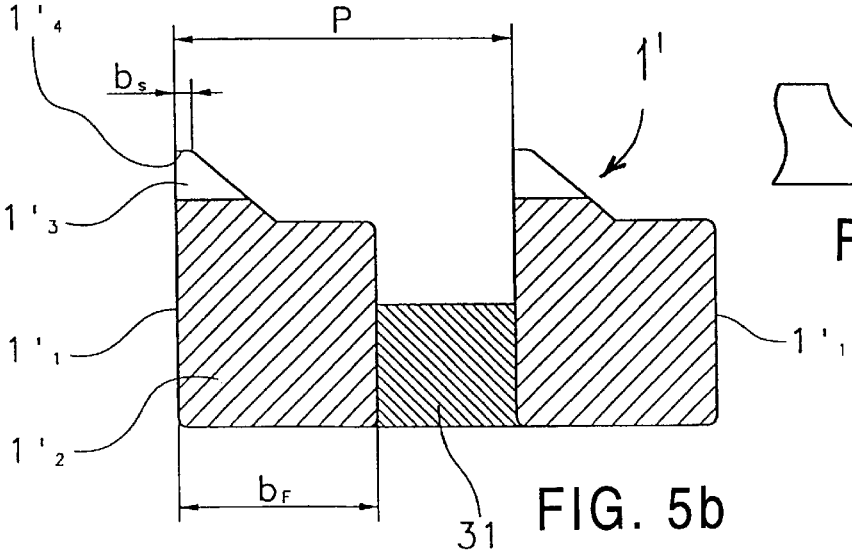
FIG. 5*b* is an axial sectional view of the sawtooth clothing according to the invention shown in a wound state (that is, installed on the roll surface).
Figure 5D:
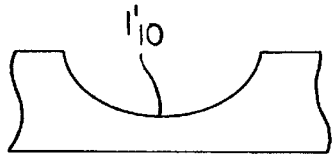
FIG. 5*d* is a fragmentary side elevational view similar to FIG. 5*a,* illustrating an approximately semicircular bottom of a tooth gap.
Figure 5C:
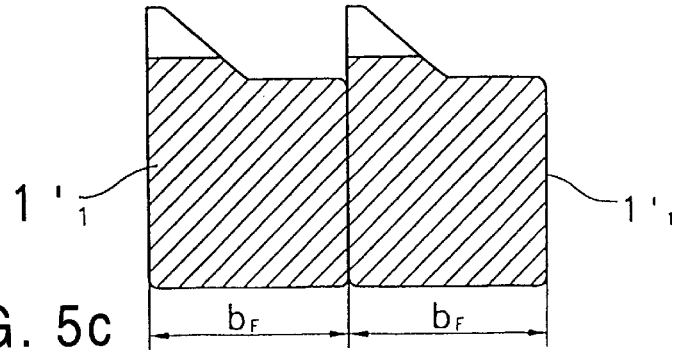
FIG. 5*c* is a view similar to FIG. 5*b,* showing a variant from which the spacer wire of the FIG. 5*b* structure is omitted.

The slowly rotating feed roll 1 is provided with a sawtooth clothing structured according to the invention, to be described in more detail in conjunction with FIGS. 5*a*, 5*b* and 5*c*. Upstream of the carding machine a fiber tuft feeder 18 is arranged which supplies a fiber lap to the carding machine 17 and which may be a DIRECTFEED model, manufactured by Trützschler GmbH & Co. KG.

Figure 2:
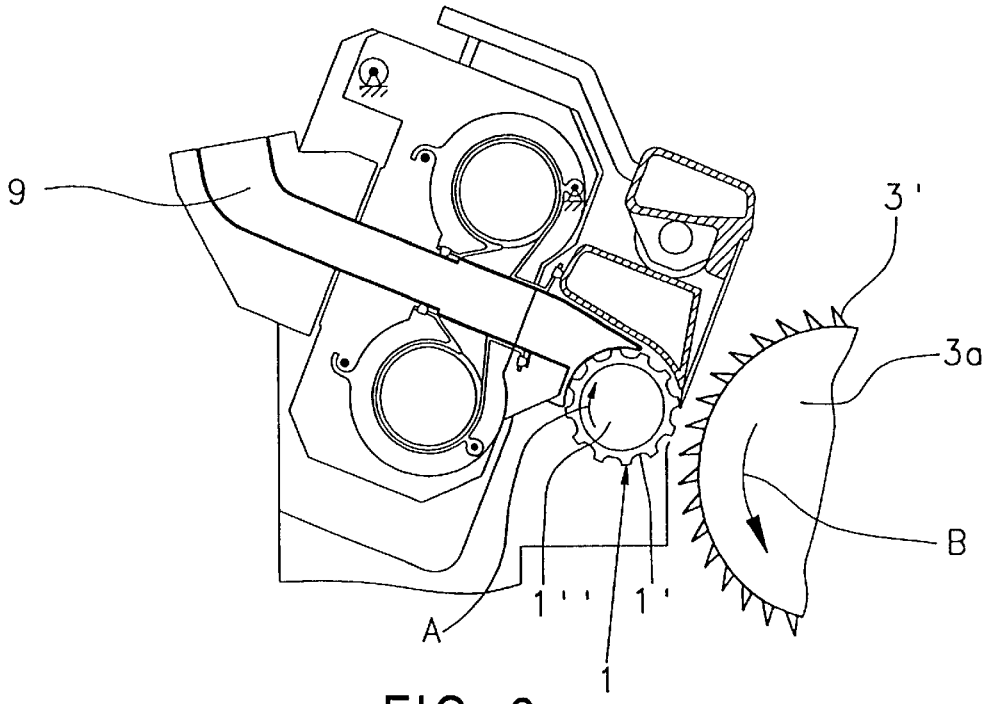
FIG. 2 is an enlarged schematic sectional detail of the structure of FIG. 1 showing a feed roll which is disposed between the lower end of a feed chute of the fiber tuft feeder and a licker-in of the carding machine and which is provided with a clothing structured according to the invention.

As shown in FIG. 2, the slowly rotating feed roll 1 moves in the direction A while the rapidly rotating licker-in 3*a* moves in the direction B. The clothing 1' of the feed roll 1 is a sawtooth wire wound helically on the roll body 1". The feed roll 1 draws fiber tufts from the feed chute 30 of the card feeder 18 and advances the tuft through the clearance between the clothing 1' and the surface 2' of the feed plate 2 towards the licker-in 3*a* which further advances the fiber tuft. The licker-in 3*a* has a clothing which is formed of short needles 3'.

Figure 3:
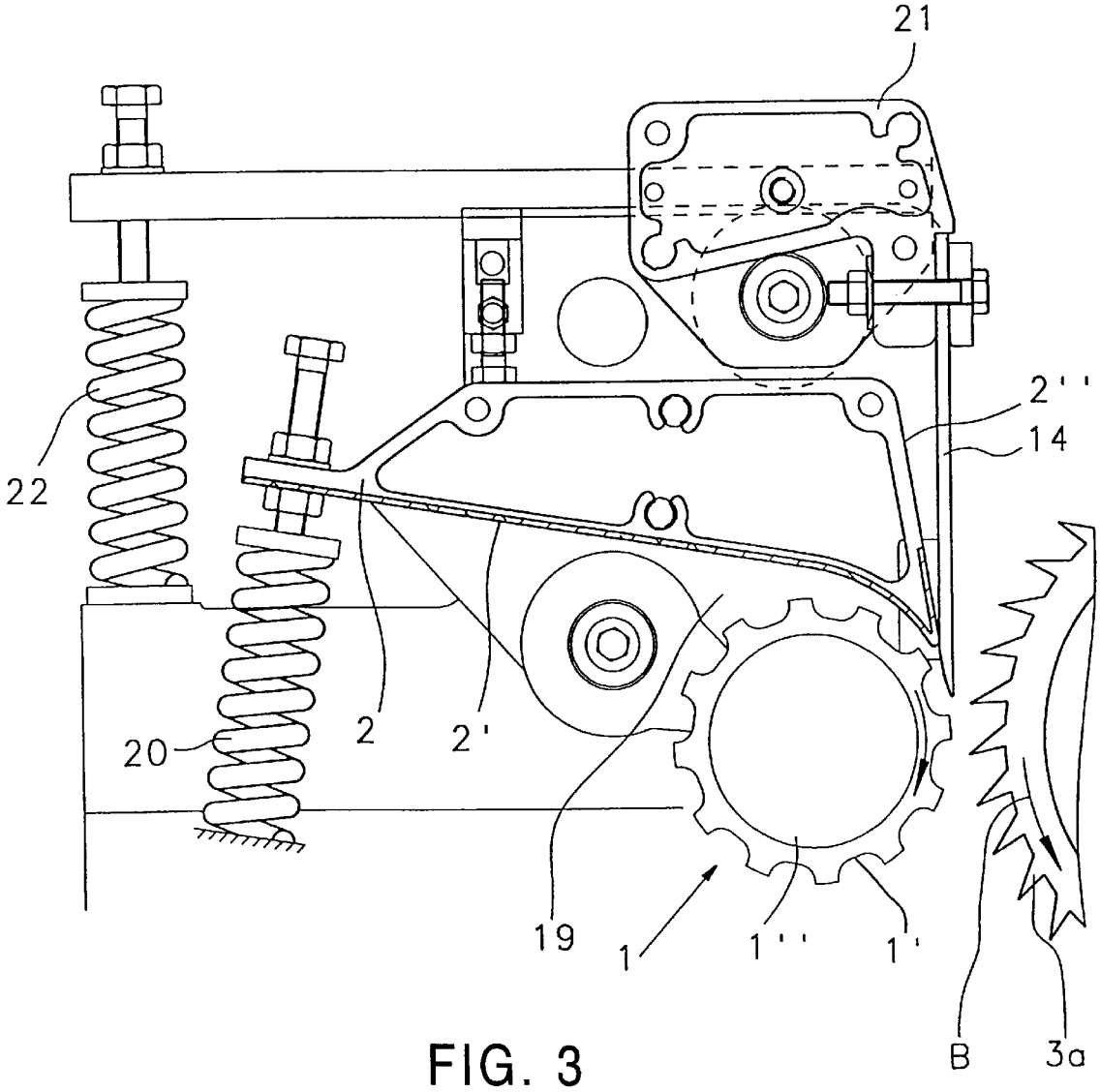
FIG. 3 is an enlarged schematic side elevational detail incorporating the invention and showing a device for measuring thickness fluctuations of the fiber material.

Turning to FIG. 3, the surface 2' of the throughgoing tray of the one-piece feed table 2 forms a clamping gap 19 with the clothing 1' of the feed roll 1. The feed table 2 is mounted on the machine frame and is biased by a spring 20 towards the feed roll 1, so that the feed table may resiliently yield in case particularly pronounced thickened portions of the running fiber material or foreign bodies are encountered. A holding element 21 which is biased by a spring 22 is also pivotally mounted on the machine frame for measuring and scanning the fiber material. The holding element 21 is a beam (summing beam) whose length is perpendicular to the plane of the drawing FIG. 3 and carries, along its length, a plurality of leaf springs 14 (only one is visible) which, at their upper end, are secured to the holding element 21 and in their lower end region serve as clamping springs for the fiber material, as they cooperate with the clothing 1' of the feed roll 1. Thus, during operation, the free (lower) end of the leaf springs 14 lifts off the end face 2" of the feed table 2 and the clothing 1' and applies a measurable torque to the beam 21. Such a device for measuring thickness fluctuations of the fiber material is disclosed in U.S. Pat. No. 5,479,679.

Figure 4:
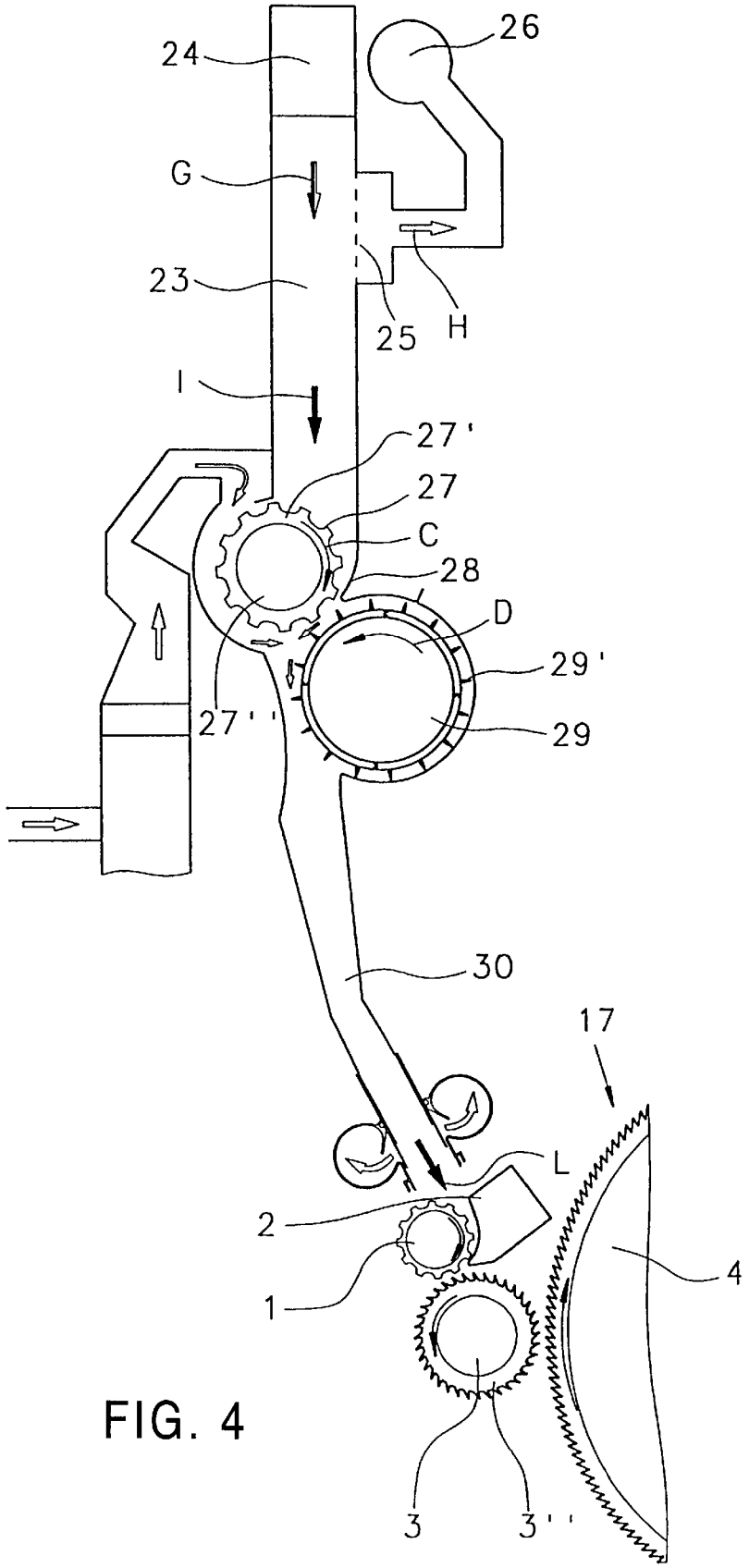
FIG. 4 is an enlarged schematic side elevational detail of FIG. 1 showing a delivery roll of the fiber tuft feeder, cooperating with an opening roll and carrying a clothing structured according to the invention.

Turning to FIG. 4, upstream of the carding machine 17 a vertically oriented reserve chute 23 is provided which is charged at the top with finely opened fiber material. Such fiber supply to the reserve chute 23 may be effected via a condenser through a pneumatic supply and distributing duct 24. In the upper zone of the reserve chute 23 air outlet openings 25 are provided, through which transporting air G passes after being separated from the fiber tufts and enters into a suction device 26 as indicated by the arrow H. The lower end of the reserve chute 23 is obturated by a delivery roll 27 which cooperates with a tray surface 28. The delivery roll 27 is provided with a sawtooth wire clothing 27' which is constructed according to the invention and which is wound helically on the roll body 27'. The slowly rotating delivery roll 27 which moves in the direction C, advances the fiber material from the reserve chute 23 to a rapidly rotating opening roll 29 which is provided on its surface with pins 29' or with a sawtooth wire clothing and which, along a path of its circumferential surface, bounds a lower chute (feed chute) 30. The opening roll 29 moving in the direction D advances the fiber material (arrow I) into the feed chute 30 from which, in turn, the fiber material (arrow h) is drawn by the feed roll 1 for advancing the material to the carding machine 17. The licker-in 3 carries a sawtooth clothing 3".

Turning to FIG. 5*a,* the sawtooth clothing 1' is viewed in a line of sight which is parallel to the roll axis, that is, the roll axis is oriented perpendicularly to the drawing plane of FIG. 5*a*. For the sake of simplicity, the clothing wire is shown as extending linearly; it will be understood that in reality, it is helically wound about the roll 1, concentrically to the roll axis.

The clothing 1' has consecutive teeth $\mathbf{1'}_1$, each having a height $h_1$ of, for example, 2.5 mm. Each tooth $\mathbf{1'}_1$ has a tooth point $\mathbf{1'}_4$ having a short straight zone $\ell_S$, for example 0.6 to 1.5 mm which extends parallel to the foot plane $\mathbf{1'}_9$ of the tooth foot $\mathbf{1'}_2$. Further, each tooth $\mathbf{1'}_1$ has a tooth breast $\mathbf{1'}_5$ and a tooth back $\mathbf{1'}_6$. The breast angle $\alpha$ is 0° or substantially 0°. The angle $\delta$, that is, the angle between the straight zone of the tooth point $\mathbf{1'}_4$ and the line at the tooth breast $\mathbf{1'}_5$ perpendicular to the foot plate $\mathbf{1'}_9$ of the tooth foot $\mathbf{1'}_2$ is 90°. The back angle $\gamma$, that is, the angle between the straight zone $\mathbf{1'}_4$ and the line at the tooth back $\mathbf{1'}_6$ perpendicular to the foot plane $\mathbf{1'}_9$ is 90°. The tooth zone above the tooth foot $\mathbf{1'}_2$ is designated at $\mathbf{1'}_3$. In each instance, between a tooth breast $\mathbf{1'}_5$ and a tooth back $\mathbf{1'}_6$ of two adjoining teeth $\mathbf{1'}_1$ a tooth gap $\mathbf{1'}_7$ is provided which has two arcs which have the approximate shape of a quarter-circle and which are interconnected by the planar gap base $\mathbf{1'}_8$. The radii of the two arcs of the tooth gap $\mathbf{1'}_7$ are designated at $r'_Z$ and $r''_Z$, and are of identical length which is approximately 0.6 mm. As an alternative to the planar gap base, the gap bottom may be cross-sectionally semicircular. The height $h_3$ of the tooth gap $\mathbf{1'}_7$ is approximately 0.6 to 1.5 mm, whereas the tooth division t is, for example, approximately 2.45 to 2.85. mm (in the straight wire). As shown in FIG. 5*d,* the bottom of the tooth gap $\mathbf{1'}_{10}$ is approximately semicircular.

FIG. 5*b* shows the sawtooth clothing 1' in a sectional view in which the line of sight is perpendicular to the roll axis which lies in the drawing plane of FIG. 5*b*. FIG. 5*b* shows two teeth $\mathbf{1'}_1$ which are thus axially spaced and which belong to two adjoining turns of the wire helix wound on the feed roll 1. The pitch between the two teeth is designated at P. Further, between the clothing helix a spacer wire 31 is helically wound on the roll body. It is feasible to omit the spacer wire 31 as illustrated in the variant shown in FIG. 5*c*. In such a case, no space between adjoining turns of the clothing helix is present. The axially measured tooth point width $b_S$ of the tooth $\mathbf{1'}_1$ may be, for example, greater than 0.2 mm and smaller than 1 mm. The axially measured foot width $b_F$ of the tooth $\mathbf{1'}_1$ (that is, the material thickness of the wire) may be greater than 1 mm and less than 4 mm, for example, 2 mm. The tooth density T=10/t may be, for example, about 3.5 to 4.0 teeth/cm. The pitch number $z=10/b_F$ may be about 4.8 to 5.2/cm. The tooth density over the surface of the roll=G×T may be about 18.5 to 19.5 $cm^2$.

In operation, the fiber material (not shown) is advanced with the tooth back $\mathbf{1'}_6$ through the gap 19 (FIG. 3) towards the licker-in 3*a*. The tooth gaps $\mathbf{1'}_7$ are filled with fiber material, and the leaf springs 14 scan the fiber material which projects beyond the tooth gaps $\mathbf{1'}_7$ and tooth points $\mathbf{1'}_4$.

The invention was, as an example, described in connection with the sawtooth clothing 1' of the feed roll 1 of the carding machine 17 and for the delivery roll 27 of a card feeder (fiber tuft feeder) 18. It should be understood that the clothing 1' according to the invention may find application in a take-in roll of an opener or cleaner in a fiber cleaning line as well.

It will be understood that the above description of the present invention is susceptible to various modifications, changes and adaptations, and the same are intended to be comprehended within the meaning and range of equivalents of the appended claims.

What is claimed is:

1. A fiber processing machine having an inlet for receiving fiber tufts to be processed; said machine including a fiber tuft advancing assembly comprising a fiber tuft advancing roll and means for advancing fiber tufts to said roll; said roll having a roll axis and a roll surface provided with a sawtooth clothing; said sawtooth clothing comprising a plurality of teeth separated from one another in a direction of roll rotation by respective tooth gaps each having a gap bottom; each tooth having a frontal flank oriented in said direction and a tooth point; said frontal flank advancing the fiber tufts upon rotation of said roll; each tooth having a tooth height $h_2$ measured from said roll surface to the tooth point and a tooth gap height $h_3$ measured from the tooth gap bottom to the tooth point; said tooth height $h_2$ and said tooth gap height $h_3$ are small for defining a small fill volume between teeth; each tooth having a back angle $\gamma$ having a magnitude of at least approximately 90° and further having a large tooth division t and a large pitch P for defining a large open space about the teeth for avoiding a feed of fiber tufts between adjoining teeth viewed circumferentially and between adjoining teeth viewed axially.

2. The fiber processing machine as defined in claim 1, wherein each tooth has a breast angle $\alpha$ having a magnitude of at least approximately 0°.

3. The fiber processing machine as defined in claim 1, wherein a tooth division t is about 2.45–2.85 mm.

4. The fiber processing machine as defined in claim 1, wherein said gap bottom is approximately semicircular.

5. The fiber processing machine as defined in claim 1, wherein said gap bottom has a substantially planar base flanked by terminal walls shaped as an arc of a quarter circle.

6. The fiber processing machine as defined in claim 5, wherein the radius of said quarter circle is about 0.6 mm.

7. The fiber processing machine as defined in claim 1, wherein each tooth point has a point length extending generally perpendicularly to said roll axis and having a magnitude greater than 0.5 mm.

8. The fiber processing machine as defined in claim 1, wherein said tooth gap height is about 0.6–1.5 mm.

9. The fiber processing machine as defined in claim 1, wherein said tooth height is about 0.8–1.5 mm.

10. The fiber processing machine as defined in claim 1, wherein each tooth point has a point width extending generally parallel to said roll axis and having a magnitude greater than 0.2 mm and less than 1.0 mm.

11. The fiber processing machine as defined in claim 1, wherein said clothing is a sawtooth wire having a material thickness greater than 1 mm and less than 4 mm.

12. The fiber processing machine as defined in claim 1, wherein a tooth density viewed in a circumferential direction of the roll is about 3.5–4.0 teeth/cm.

13. The fiber processing machine as defined in claim 1, wherein said clothing includes a clothing wire wound on said roll surface in turns, and further wherein the number of turns is about 4.8–5.2/cm.

14. The fiber processing machine as defined in claim 1, wherein a tooth density over said roll surface is about 18.5–19.5 teeth/$cm^2$.

15. The fiber processing machine as defined in claim 1, wherein said machine is a carding machine, and wherein said fiber tuft advancing roll is a feed roll of said carding machine.

16. The fiber processing machine as defined in claim 1, wherein said machine is a fiber tuft feeder, and wherein said fiber tuft feeder has a feed chute and said fiber tuft advancing roll is a delivery roll advancing fiber tufts toward said feed chute.

17. The fiber processing machine as defined in claim 1, wherein said machine is a fiber tuft cleaner, and wherein said fiber tuft advancing roll is a take-in roll of said cleaner.

18. The fiber processing machine as defined in claim 1, wherein said machine is a fiber tuft opener, and wherein said fiber tuft advancing roll is a take-in roll of said opener.

19. The fiber processing machine as defined in claim 1, further comprising a device for measuring thickness fluctuations of the fiber tufts during conveyance thereof by said roll.

* * * * *